United States Patent [19]

DeGaynor

[11] Patent Number: 4,550,575

[45] Date of Patent: Nov. 5, 1985

[54] ICE BOWL FREEZING APPARATUS

[76] Inventor: G. Scott DeGaynor, 188 Wealthy, SW., Grand Rapids, Mich. 49503

[21] Appl. No.: 694,831

[22] Filed: Jan. 25, 1985

Related U.S. Application Data

[63] Continuation of Ser. No. 518,648, Jul. 29, 1984, abandoned.

[51] Int. Cl.[4] ..... F25C 1/18

[52] U.S. Cl. ..... 62/308; 62/1; 62/356; 248/153; 261/123; 264/28; 264/278

[58] Field of Search ..... 62/1, 66, 67, 70, 307, 62/308, 340, 356; 249/93, 120, 139; 264/278, 28, 279.1; 248/153; 261/123; 366/262

[56] References Cited

U.S. PATENT DOCUMENTS 210,034 11/1878 Higgins et al. ..... 261/123
1,169,164 1/1916 Kirkpatrick ..... 62/308 X
1,322,660 11/1919 Voorhees ..... 62/356 X
3,123,885 3/1964 Marler ..... 249/139

*Primary Examiner*—William E. Tapolcai
*Attorney, Agent, or Firm*—Robert M. Ward

[57] ABSTRACT

A self-contained, decorative ice bowl freezing apparatus, including a bowl mold for containing the water to be frozen into the ice bowl; air circulation means disposed within the bowl mold for supplying a stream of air to the freezing water to slow the freezing thereof to provide ice in greater clarity; support means for the air circulation means; a freezer tank containing a refrigerant liquid into which the bowl mold is disposed and held at a selected level; and refrigerant liquid circulation means disposed within the freezer tank for continuously circulating the refrigerant liquid to prevent stratification of temperature levels within the refrigerant liquid, whereby uniformity of freezing of the water in the bowl mold is enhanced.

23 Claims, 7 Drawing Figures

ICE BOWL FREEZING APPARATUS

This is a continuation of application Ser. No. 518,648, filed July 29, 1984, now abandoned.

BACKGROUND OF THE INVENTION

The present invention is directed generally to an apparatus for producing decorative ice products and, more specifically, to a self-contained, decorative ice bowl freezing apparatus.

In the prior art, it has been desirable for special occasions, such as weddings, birthday parties, graduation parties, anniversaries, etc., to provide sculptures and/or other objects made of ice as decorative features for the occasion. One such item has been a bowl made of ice. Such ice bowls have, in the past, been carved from a solid block of ice to include a cavity in the central portion thereof. In the central cavity of such carved ice bowls, a punch bowl has often been disposed in such prior art embodiments. However, such prior art carved ice bowls have been time consuming and expensive to produce and have required considerable skill in the manufacture thereof, often involving a waste of one or more blocks of ice due to slips of the craftsman and/or faults in the ice blocks which have led to fractures thereof.

An improvement over the hand-carved ice bowl has been the ice bowl which is formed by freezing water in a mold. One advantage of this type of improved ice bowl of the prior art has been that these improved techniques have permitted the inclusion of various decorative elements, such as flowers, letters, paper letters, or other decorative or visual indicia, within the structure of the ice bowl. However, a major disadvantage of such prior art molded ice bowls has been the necessity of requiring an ice block plant in order to freeze-form such molded ice bowls. This disadvantage has had the additional disadvantages of requiring a large capital investment in order to produce molded ice bowls; has made the source of supply of such ice bowls relatively concentrated; and has denied consumers in many areas of the country the benefit of such decorative ice bowls due to the fragile and ephemeral quality of these decorative ice bowls.

In view of the shortcomings and disadvantages of prior art ice bowl-forming techniques and devices, it is a material object and intent of the present invention to provide an improved, self-contained, decorative ice bowl freezing apparatus which will substantially overcome such disadvantages.

SUMMARY OF THE INVENTION

The present invention is directed to a self-contained, decorative ice bowl freezing apparatus which includes a bowl mold containing the water to be frozen. An air circulation means preferably in the form of a generally frusto-conical shaped element is disposed within the water in the bowl mold. Such air circulation means provides a preferably continuous stream of air bubbles to the freezing water in the center portion of the bowl for the purpose of slowing the freezing thereof to provide ice of a greater clarity. Such air circulation means also permits initial freezing of the water substantially adjacent to the walls of the bowl, such that the water in the middle of the bowl does not freeze, and also to permit the introduction of decorative indicia within the freezing bowl structure after the water immediately adjacent the bowl mold walls has frozen.

The bowl mold of the improved ice bowl freezing apparatus of the present invention is contained and held at a selected height within a freezer tank. The freezer tank contains a refrigerant liquid that is circulated, preferably continuously therein, to prevent stratification of temperature levels within the refrigerant liquid, and thereby to promote uniformity of freezing of the water in the bowl mold.

Additional elements, advantages, and features of the preferred and alternative embodiments of the improved ice bowl freezing apparatus of the present invention will be better understood by those having ordinary skill in the art based upon review of the following brief description of the drawing, the associated drawing, detailed description of the preferred embodiments, and the appended claims.

BRIEF DESCRIPTION OF THE DRAWING

In the drawing hereof, various preferred and alternative embodiments of the present invention are set forth in which common numerals are utilized to designate common elements, and in which.

DETAILED DESCRIPTION OF PREFERRED EMBODIMENTS

Figure 1:
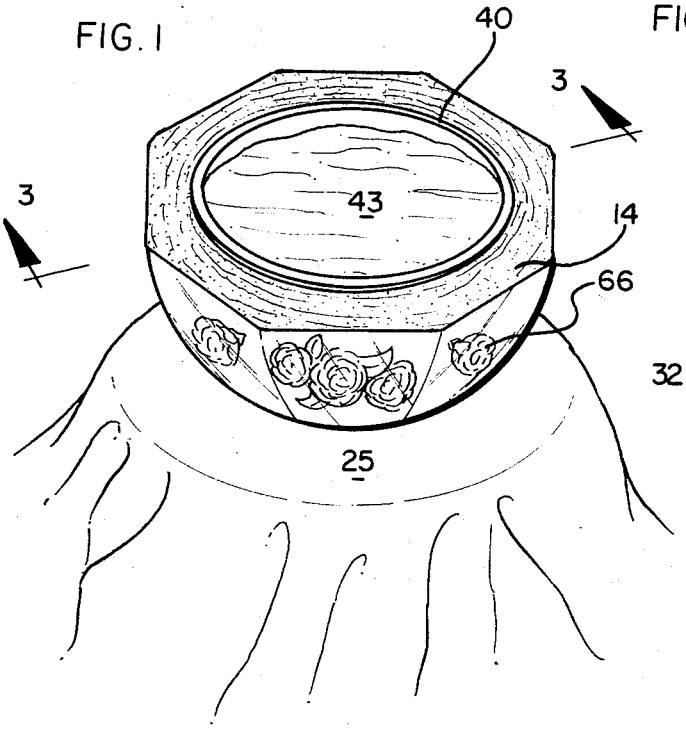
FIG. 1 is a perspective view of a decorative ice bowl produced by means of the self-contained decorative ice bowl freezing apparatus of the present invention showing the decorative ice bowl with decorative indicia contained within the frozen walls thereof, and containing a punch bowl insert within the central portion of such ice bowl, such punch bowl insert containing a comestible liquid therein, and with the ice bowl resting on an ice bowl stand as shown in FIG. 2 which is covered by a cloth.

The present invention is directed to a self-contained, decorative ice bowl freezing apparatus. The improved apparatus of the present invention includes a bowl mold which is the size and shape of the desired ice bowl. The bowl mold contains water in the central cavity thereof to be frozen and to form the ice bowl in its frozen state. The bowl mold has an upper extremity around the rim thereof, and a lower centrally disposed outwardly extending protrusion for forming the base of the ice bowl.

Air circulation means are disposed within the opening of the bowl mold from the top of the mold for supplying a stream of air bubbles to the freezing water in the bowl mold. The stream of air bubbles functions to slow down the freezing of the ice bowl to provide ice of greater clarity. The stream of air bubbles also permits freezing of the water adjacent to the walls of the bowl mold first, and prevents freezing of the water in the center of the bowl mold, such that when remaining unfrozen water is removed from the central area of the bowl, a frozen bowl shape results therefrom.

Support means are provided for the air circulation means within the opening of the bowl at the top thereof to direct the stream of air into the central portion of the water within the bowl mold cavity.

A freezer tank is provided and has an opening at the top thereof into which the bowl mold is disposed therewithin. The freezer tank contains a refrigerant liquid, such as brine or a glycol or other eutectic liquid, the level of which extends in the freezer tank upwardly for a substantial distance, such that the side of the bowl mold is covered to a level less than that of the upper extremity of the bowl mold. Thus, the bowl mold is substantially immersed within the refrigerant liquid contained within the freezing tank, but the refrigerant liquid does not spill over into the bowl mold to contaminate the freezing water therein. Although the ice bowl is not intended to be a comestible, it is used as a shell into which a punch bowl insert is placed. Accordingly, the refrigerant liquid used should be relatively nontoxic.

Refrigerant liquid circulation means are disposed within the freezer tank for circulating the refrigerant liquid. The circulation means for the refrigerant liquid prevents stratification of temperature levels within the refrigerant liquid. Uniformity in freezing of the water in the bowl is thus enhanced. A bowl mold support means is disposed, and in some embodiments, at least partially within the freezer tank, to engage the bowl mold to fixedly support the bowl mold at the selected level within the freezer tank.

The bowl mold may be preferably made of a metallic material for rapid conduction of heat therefrom to lower freezing times. The bowl mold preferably further includes a lip extending laterally from the upper portion or rim of the bowl mold to engage the bowl mold support means on the underside of the rim, and to engage the air circulation support means on the upper surface thereof.

Such lateral extending lip is further preferably connected on the outward extremity thereof to an upwardly extending flange. The upwardly extending flange prevents contamination of the freezing water contained within the cavity of the bowl mold with refrigerant liquid that is contained within the tank. The upwardly extending flange further forms means for centering the air circulation means with respect to the bowl mold. The result is to promote uniformity of bowl wall thickness formed by the freezing water therein.

In preferred embodiments of the decorative bowl freezing apparatus of the present invention, the air circulation means comprises an air tube having a length to extend a substantial distance into the water contained within the bowl mold and having an air tube aperture at the distal end thereof. An air supply means is provided and is connected to the proximal end of the air tube for furnishing a stream of air to the air tube to be thereafter directed downwardly into the water within the bowl mold to bubble upwardly therefrom. The air circulation means of the present invention preferably continuously supplies a stream of air bubbles to the freezing water within the bowl mold.

An air bubble deflection means is disposed within the bowl mold and has a surface in contact with the water thereof. The air bubble deflection means functions to deflect the air bubbles which flow upwardly from the air aperture of the air tube within the water in the bowl mold. Such stream of air bubbles is directed substantially outwardly from the center of the water in the cavity in the bowl mold and toward the sides thereof. Such deflection means is preferably substantially frusto-conical in shape.

Decorative indicia holding means are also preferably further provided for holding decorative indicia, such as flowers, paper or plastic letters, or other decorations, at selected positions in the freezing water contained within the bowl mold. Such decorative indicia are thus incorporated within the walls of the ice bowl when frozen. The decorative indicia holding means preferably includes a length of relatively rigid wire with a clip disposed at each end thereof. One clip may be connected to the decorative visual indicia and the other clip used to hold the wire and the attached decorative visual indicia in the selected position within the water contained within the bowl mold.

The air circulation support means of preferred embodiments of the present invention preferably includes longitudinally extending support plates that are joined by laterally extending support plates to form an air circulation support frame. Such air circulation support frame is adapted for removal temporarily from the top of the bowl mold after partial freezing of the ice bowl and for ease of positioning of the decorative visual indicia. Thereafter, the air circulation support frame is repositioned within the top of the central cavity of the bowl mold to complete the freezing of the ice bowl. The air circulation means is preferably attached to and is borne by the laterally extending support plates of the air circulation support frame.

In preferred embodiments of the present invention, the refrigerant liquid circulation means is continuous in operation. The refrigerant liquid circulation means preferably includes a refrigerant pump disposed within the freezing tank and submersed within the refrigerant liquid. The refrigerant pump preferably includes influent and effluent openings thereon. A loop of refrigerant circulation tubing is connected to a T-fitting attached to the effluent opening of the refrigerant pump for continuous circulation of refrigerant therein. The loop of refrigerant circulation tubing preferably contains a plurality of upwardly directed apertures in the upper surface thereof for providing substantial uniformity and circulation of the refrigerant liquid to the freezing tank.

The bowl support frame preferably comprises a frame having a pair of upwardly extending rod elements oppositely directed on the lateral sides thereof. Each of the upwardly extending rod elements supports a transversely and substantially horizontally extending rod element for engaging and supporting the bowl mold.

Figure 2:
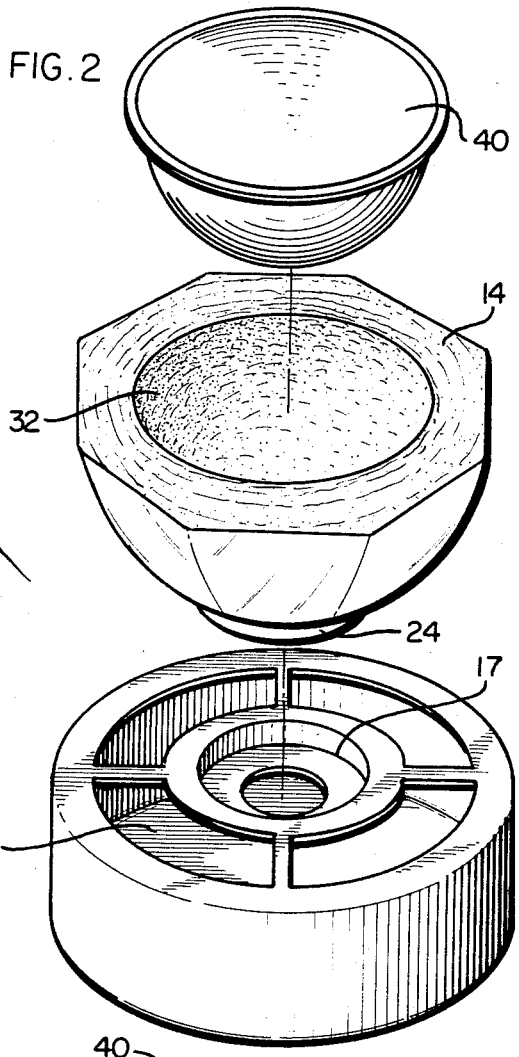
FIG. 2 is an exploded, perspective view of the decorative ice bowl freezing apparatus of the present invention, and showing (from top to bottom) the punch bowl insert, the decorative ice bowl, and the ice bowl stand having a centrally disposed bowl supporting and draining mechanism.
Figure 3:
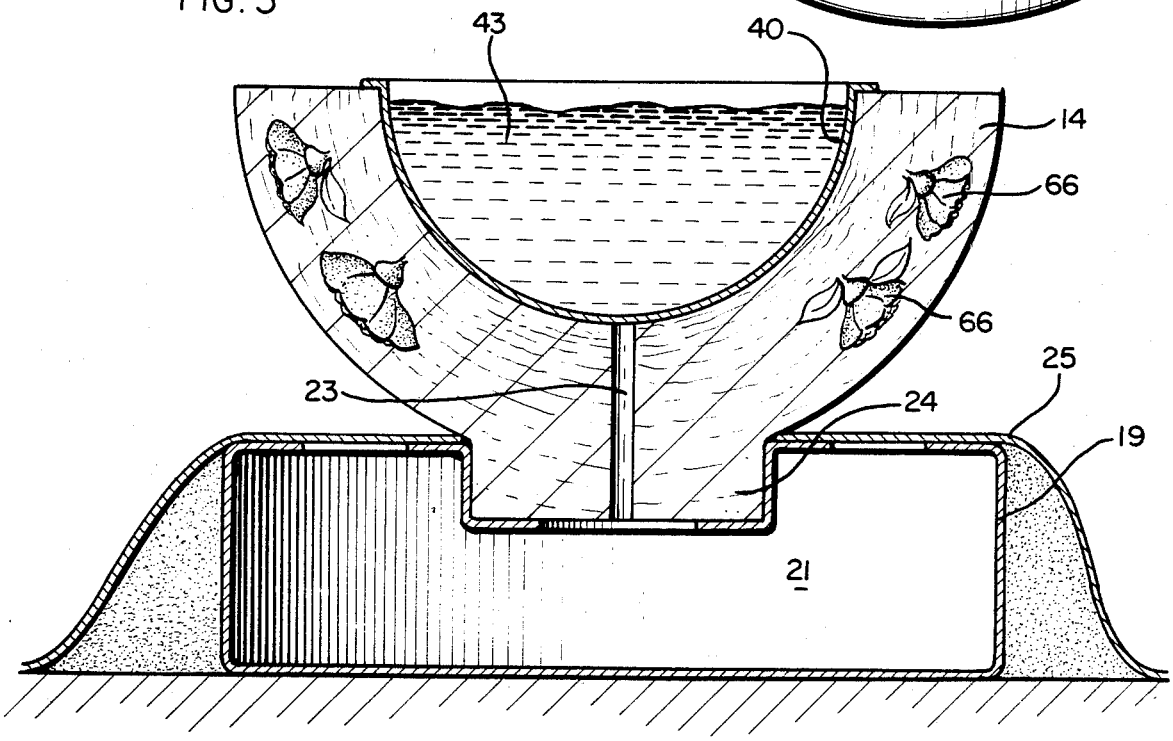
FIG. 3 is an enlarged, cross-sectional view taken along line 3—3 of FIG. 1, and showing the punch bowl inserted into the central cavity of the decorative ice bowl, such decorative ice bowl having a water-draining hole disposed therethrough to permit drainage of melted water into the drainage portion of the ice bowl stand, which is shown covered by a cloth.
Figure 4:
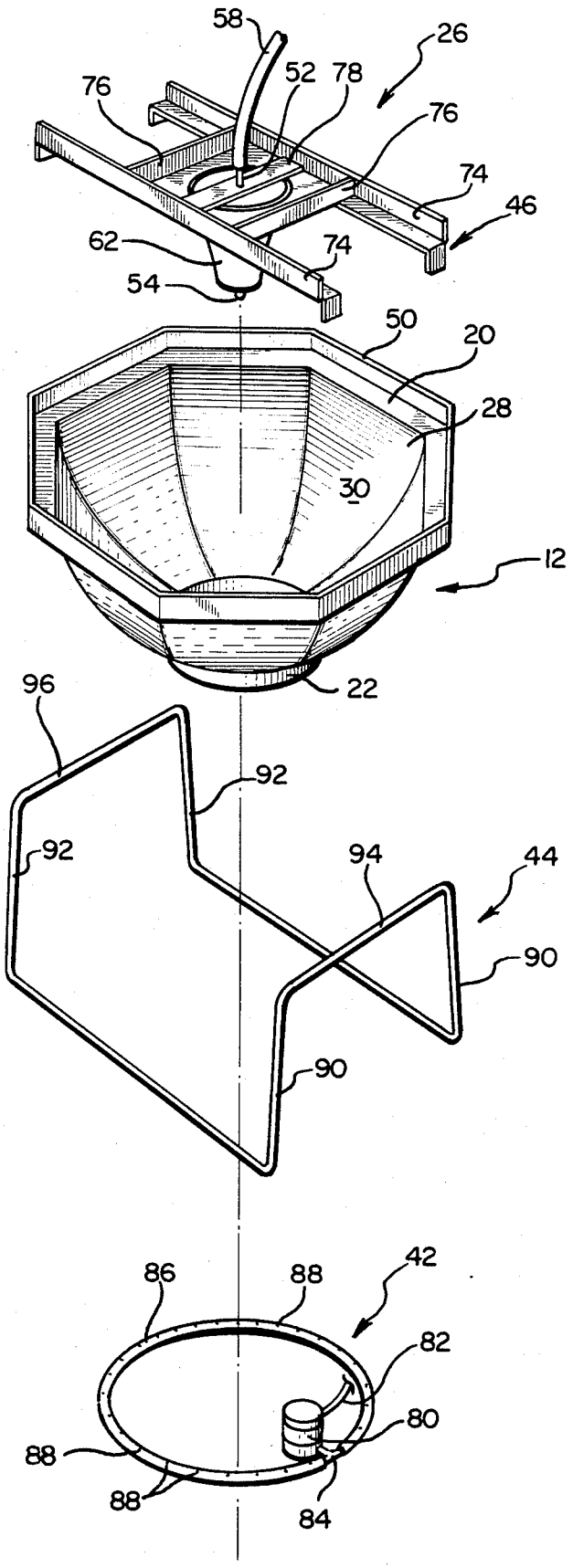
FIG. 4 is a greatly exploded, perspective view of the functional elements of the decorative ice bowl freezing apparatus of the present invention, and showing (from top to bottom) the air circulation means having an air tube disposed within a generally frusto-conical shaped air bubble deflection surface and being supported by an air circulation support means in the form of a longitudinally and laterally extending frame, such air circulation means being disposed into the bowl mold which has a lip thereon for supporting the air circulation support means at the upper portion thereof and for engaging with the bowl mold support means at the under surface thereof, and disposed at the bottom continuously operating refrigerant liquid circulation means in the form of a pump having a closed loop with such loop having a multiplicity of upwardly opening apertures therein.
Figure 5:
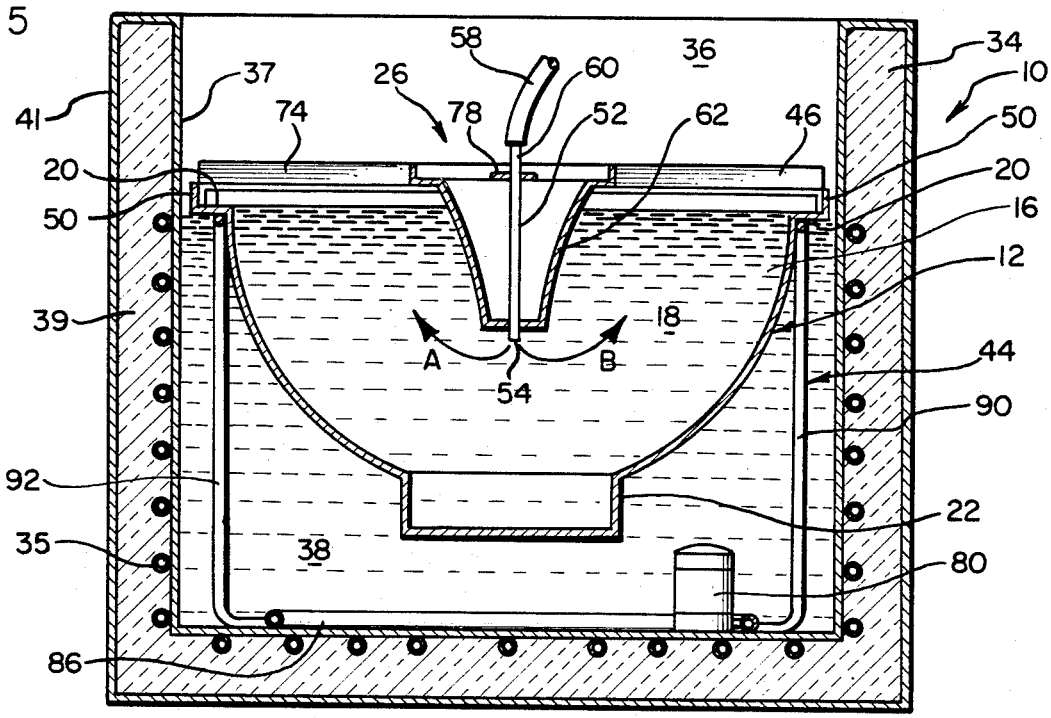
FIG. 5 is an enlarged, transverse, cross-sectional view, and showing the elements as set forth in FIG. 4 and in a nonexploded and operative disposition within the freezing tank, such freezing tank having freezing coils around the inner liner thereof, and insulation being provided between the inner liner and the outer shell of the freezing tank, and further showing the circulation flow path of the stream of air bubbles from the air circulation means upwardly and as deflected by the deflection surface of the generally frusto-conical shaped surface.
Figure 6:
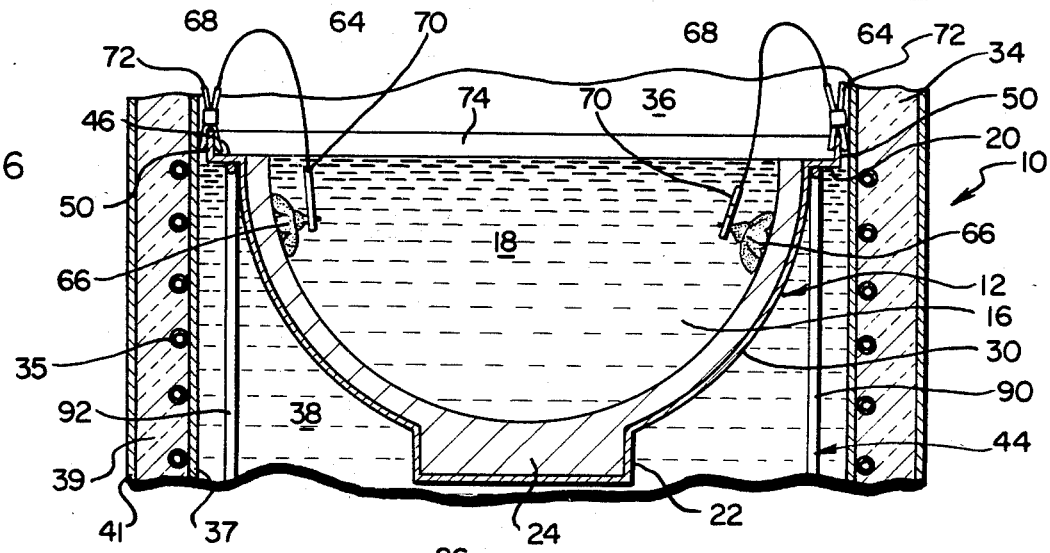
FIG. 6 is a fragmented and enlarged lateral, cross-sectional view of the ice bowl freezing apparatus of the present invention, and showing the ice bowl being partially frozen within the central cavity of the bowl mold, and decorative indicia being inserted therein in the form of flowers which are held in place by means of clips, with the air circulation means being temporarily removed for ease of positioning of such decorative indicia.
Figure 7:
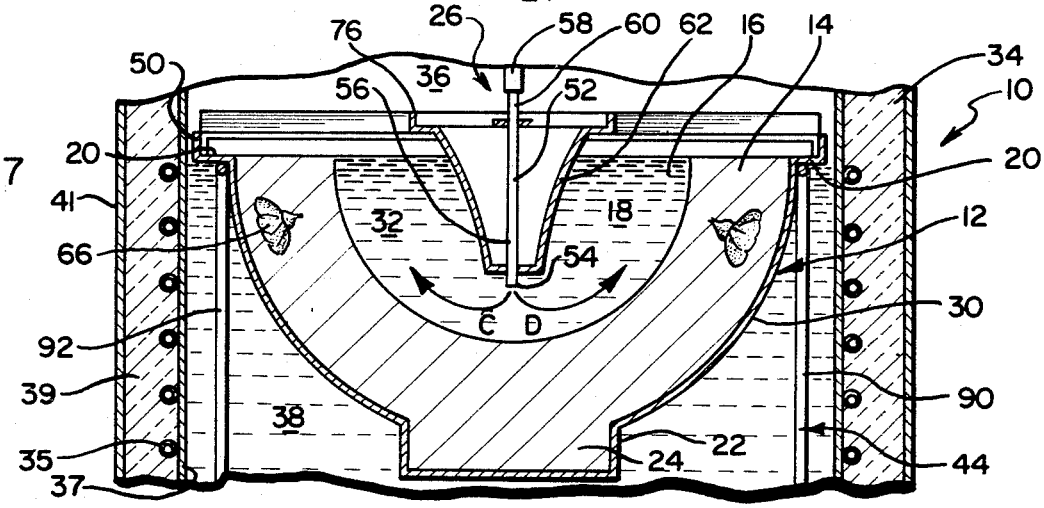
FIG. 7 is an enlarged, lateral, cross-sectional view, and showing the air circulation means having been reinserted into the bowl mold central cavity after the introduction of visual indicia which have been frozen into the now fully formed walls of the frozen bowl, which bowl is now ready for removal from the freezer tank and draining of the central cavity of the ice bowl.

Referring now to the drawing and to FIGS. 5–7 in particular, the present invention is directed to a self-contained, decorative ice bowl freezing apparatus generally 10. The present invention comprises a bowl mold generally 12 as shown in FIGS. 4–7, which is the size and shape of the desired ice bowl 14 as shown in FIGS. 1–3 in particular. Bowl mold 12 contains water 16 in the central cavity 18 thereof to be frozen and to form ice bowl 14 in its frozen state.

As shown particularly in FIG. 4, bowl mold 12 has a lip 20 around the upper extremity thereof, and a lower centrally disposed outward protrusion 22 for forming the base 24 of ice bowl 14.

As shown in FIGS. 2 and 3, base 24 of ice bowl 14 fits into receptical 17 of ice bowl stand 19 which contains a container portion 21 for collecting melting water dripping from ice bowl 14. Ice bowl 14 further preferably has an aperture 23 therein for draining the center of bowl 14. A cover 25 such as a tablecloth may be preferably provided for covering ice bowl stand 19.

Air circulation means generally 26 as shown in FIG. 4 are disposed within the central cavity 18 of bowl mold 12 from the top portion 28 of mold 12 for supplying a stream of air bubbles, schematically shown as arrows A, B, C, D of FIGS. 5 and 7, to freezing water 16 in bowl mold 12. The stream of air bubbles A, B, C, D functions to slow down the freezing of water 16 as it gradually forms ice bowl 12 to provide ice of greater clarity. As shown in FIG. 6, the stream A, B, C, D of air bubbles also permits freezing first of the water 16 adjacent to the walls 30 of bowl mold 12, and prevents freezing of water 16 in central cavity 18 of bowl mold 12, such that when remaining frozen water 16 is removed from central portion 32 of the frozen ice bowl 12 as shown in FIG. 7, a frozen bowl shape results therefrom. Support means are provided, disposed at the top portion 28 of bowl mold 12 for air circulation means 26 for positionally holding air circulation means 26 within central cavity 18 of bowl mold 12, to direct the stream A, B, C, D of air into the water 16 within bowl mold central cavity 18.

As shown in FIGS. 5–7, freezer tank 34 is provided and has an opening 36 at the top thereof into which bowl mold 12 is disposed therewithin.

Freezer tank 34 includes a plurality of freezing coils 35 disposed on the inner liner 37 thereof, with insulation 39 being provided between inner liner 37 and outer shell 41 of freezer tank 34. The freezer tank 34 contains a refrigerant liquid 38, such as brine or a glycol or other eutectic liquid, the level of which extends in freezer tank 34 upwardly a substantial distance, such that the walls 30 of bowl mold 12 are covered to a level less than that of the lip 20 of bowl mold 12. Thus, bowl mold 12 is substantially immersed within refrigerant liquid 38 contained within freezer tank 34, but refrigerant liquid 38 does not spill over into bowl mold 12 to contaminate freezing water 16 therein. Although ice bowl 14 is not intended to be comestible, it is used as a shell into which a punch bowl insert 40 is placed as shown in FIGS. 1–3. Punch bowl insert 40 contains a comestible 43, such as punch, etc. Accordingly, refrigerant liquid 38 should be relatively nontoxic.

Refrigerant liquid circulation means generally 42 as shown in FIG. 4 is disposed within freezer tank 34 for circulating refrigerant liquid 38. The circulation means 42 for refrigerant liquid 38 functions to prevent stratification of temperature levels within refrigerant liquid 38. Uniformity in freezing of water 16 in bowl mold 12 is thus enhanced. Bowl mold support means generally 44 as shown in FIG. 4 is disposed within freezer tank 34 and engages bowl mold 12 to fixedly support bowl mold 12 at the selected level within freezer tank 34 as shown in FIGS. 5–7.

Bowl mold 12 preferably further includes an air circulation support means which extends from lip 20 thereof for engaging and supporting the support means generally 46 as shown in FIG. 4 for air circulation means 26. Such air circulation support means 46 and bowl mold support means 44, as shown in FIGS. 5–7, preferably comprises lip 20 extending laterally from top portion 28 of bowl mold 12 to engage the bowl mold support means 44 on the underside of lip 20, and to engage air circulation support means 46 on the upper surface of lip 20. Such lateral extending lip 20 is further preferably engaged on the outward extremity thereof by an upwardly extending flange 50. Upwardly extending flange 50 prevents contamination of freezing water 16 contained within the central cavity 18 of bowl mold 12 with refrigerant liquid 38 that is contained within tank 34. Upwardly extending flange 50 is further disposed upon and is connected to the extremity of lip 20 to form means for engaging air circulation support means 46 for centering air circulation means 26 with respect to bowl mold 12. The result is to promote uniformity of a bowl wall thickness formed by the freezing water therein.

In preferred embodiments of the decorative bowl freezing apparatus 10 of the present invention, air circulation means 26 comprises an air tube 52 having a length to extend a substantial distance into water 16 contained within central cavity 18 of bowl mold 12 and having an air tube aperture 54 at the distal end 56 thereof. An air supply means (not shown) connected by air hose 58 is provided at the proximal end 60 of air tube 52 for furnishing air to air tube 52 to be thereafter directed downwardly into water 16 within the bowl mold to bubble upwardly therefrom in streams A, B, C, D. An air bubble deflection means 62 is disposed within bowl mold 12 and the surface thereof in contact with water 16. Air bubble deflection means 62 preferably having a generally frusto-conical shape functions to deflect air bubble streams A, B, C, D which flow upwardly from air tube aperture 54 of air tube 52 within water 16 in bowl mold 12. Such streams A, B, C, D of air bubbles are directed substantially outwardly from the central portion of water 16 in the central cavity 18 of bowl mold 12 and toward the walls 30 thereof.

Decorative indicia holding means generally 64, as shown in FIG. 6, are also preferably further provided for holding decorative indicia 66, such as flowers, paper or plastic letters, or other decorations, at selected positions in the freezing water 16 contained within bowl mold 12 as shown in FIG. 6. Such decorative indicia 66 are thus incorporated within ice bowl 14 when frozen. Such decorative indicia holding means 64 preferably include a length of relatively rigid wire 68 with clips 70, 72 disposed at each end thereof. One clip 70 may be connected to the decorative visual indicia 66, and the other clip 72 used to hold wire 68 and the attached decorative visual indicia 66 in the selected position within water 16 contained within bowl mold 12. Clip 72 may be attached to upwardly extending flange 50 extending from lip 20 of bowl mold 12.

Air circulation means 26 of the present invention preferably continuously supplies streams A, B, C, D of air bubbles to freezing water 16 within central cavity 18 of bowl mold 12.

Air circulation support means 46 in preferred embodiments of the present invention preferably includes longitudinally extending support plates 74 that are joined by laterally extending support plates 76 that form an air circulation support frame 78 as shown in FIG. 4. Such air circulation support frame 78 is easily removed from the top portion 28 of bowl mold 12 after partial freezing of ice bowl 14 and for ease of positioning of the decorative visual indicia therein as shown in FIG. 6. Thereafter, the air circulation support frame 78 is repositioned within top portion 28 of central cavity 18 of bowl mold 12 to complete the freezing of ice bowl 14 as shown in FIG. 7. Air circulation means 26 is attached to and is borne by laterally extending support plates 76 of air circulation support frame 78.

In the preferred embodiment of the present invention, the refrigerant liquid air circulation means 42 is continuous in operation. Refrigerant liquid circulation means 42 preferably includes a refrigerant pump 80 disposed within freezing tank 34 and submersed within refrigerant liquid 38. Refrigerant pump 80 preferably includes an influent opening 82 and an effluent opening 84 thereon. A loop 86 of refrigerant circulation tubing is connected to a T-fitting attached to effluent opening 84 of refrigerant pump 80 for continuous circulation of refrigerant therein. The loop 86 of refrigerant circulation tubing preferably contains a plurality of upwardly directed apertures 88 in the upper surface thereof for providing substantial uniformity and circulation of refrigerant liquid 38 to freezing tank 34.

As best shown in FIG. 4, the bowl support frame preferably has at both ends thereof a pair of upwardly extending rod elements 90, 90, 92, 92. Each pair 90, 90 and 92, 92 of the upwardly extending rod elements respectively supports a transversely extending rod element 94, 96 for engaging and supporting bowl mold 12.

In preferred embodiments of the present invention, bowl mold 12 includes an outward protrusion 22 at the bottom thereof for forming base 24 of bowl 14.

Although the invention has been described in terms of various preferred embodiments of the improved ice bowl freezing apparatus, it will be apparent to those skilled in the art that many alterations and modifications may be made without departing from the invention. Accordingly, all such alterations and modifications are intended to be considered as within the spirit and scope of the invention as defined by the appended claims.

What is claimed is:

1. A self-contained, decorative ice bowl freezing apparatus, said apparatus comprising:

a bowl mold means for forming an ice bowl of a selected size and shape, said bowl mold means for containing water to be frozen adjacent the walls thereof only and for forming the ice bowl thereby, and said bowl mold means having an upper extremity around the rim thereof;

air circulation means disposed within the opening of said bowl mold means from the top thereof for supplying a stream of air bubbles to the freezing water in said bowl mold means for slowing the freezing thereof to provide ice of greater clarity, and also for freezing of the water substantially adjacent to the walls of the bowl mold means, but simultaneously for maintaining the water in the center of the bowl mold means continuously in an unfrozen condition, such that when the remaining unfrozen water is removed from the central area of the bowl mold means, a frozen bowl shape results therefrom;

frame means mounted on substantially the upper extremity of the bowl mold means for positionally holding said air circulation means within the opening of said bowl mold means at the rim thereof;

a portable and free-standing freezer tank, said freezer tank having an opening at the top thereof and said bowl mold means disposed therewithin, said freezer tank being adaptable for containing a refrigerant liquid, the level of which in said freezer tank extends a substantial distance up the side of said bowl mold means to a level less than that of the upper extremity of said bowl mold means, whereby said bowl mold means is substantially immersed within the refrigerant liquid contained within, but the refrigerant liquid does not spill over the bowl mold means to contaminate the freezing water thereof;

refrigerant liquid circulation means disposed solely within said freezer tank for circulating the refrigerant liquid thereof and to prevent stratification of temperature levels within the refrigerant liquid, whereby uniformity of freezing of the water in the bowl mold means except in the center of said bowl mold means is enhanced; and frame means engaging substantially the upper extremity of said bowl mold means to fixedly support said bowl mold means at the selected level within said freezer tank.

2. The self-contained, decorative ice bowl freezing apparatus of claim 1 wherein said bowl mold is made of a metallic material for rapid conduction of heat.

3. The self-contained, decorative ice bowl freezing apparatus of claim 1 wherein said bowl mold further include a lip for engaging and supporting said air circulation support means.

4. The self-contained, decorative ice bowl freezing apparatus of claim 3 wherein said bowl mold further has means for engaging said bowl mold support means.

5. The self-contained, decorative ice bowl freezing apparatus of claim 3 wherein said lip extends laterally from the top portion of said bowl mold to engage said bowl mold support means on the under side of said lip, and to engage said air circulation support means on the upper surface thereof.

6. The self-contained, decorative ice bowl freezing apparatus of claim 5 wherein said laterally extending lip is connected on the outward extremity thereof to an upwardly extending flange for prevention of contamination of the freezing water contained therein with the refrigerant liquid contained within said freezer.

7. The self-contained, decorative ice bowl freezing apparatus of claim 6 wherein said upwardly extending flange disposed upon and connected to the outward extremity of said lip comprises means for engaging said air circulation support means for centering said air circulating means with respect to said bowl mold, thereby to promote uniformity of bowl wall thickness formed by the freezing of the water therein.

8. The self-contained, decorative ice bowl freezing apparatus of claim 1 wherein said air circulation means comprises:

an air tube having a length to extend a substantial distance into the water contained within said bowl mold and having an air tube aperture at the distal end thereof;

an air supply means for furnishing a stream of air to said air tube at the proximal end thereof to be thereafter directed downwardly into the water within said bowl mold to bubble upwardly therefrom; and an air bubble deflection means having a surface in contact with and submersed into the water in said bowl mold, whereby the air bubbles which flow upwardly from the air tube aperture of the air tube within the water in said bowl mold are also directed to flow substantially outwardly from the center of such water and towards the sides of said bowl mold.

9. The self-contained, decorative ice bowl freezing apparatus of claim 8 wherein said air bubble deflection means is substantially frusto-conical in shape.

10. The self-contained, decorative ice bowl freezing apparatus of claim 1 further comprising decorative indicia holding means for holding decorative indicia at selected positions in the freezing water contained within said bowl mold, such decorative indicia to be incorporated within the walls of the ice bowl when frozen.

11. The self-contained, decorative ice bowl freezing apparatus of claim 10 wherein said decorative indicia holding means comprises a length of relatively rigid wire with a clip disposed on each end thereof whereby one clip may be connected to the decorative indicia and the other clip used to hold the entirety of the wire, and including the decorative visual indicia in the selected position within the water contained within the bowl mold.

12. The self-contained, decorative ice bowl freezing apparatus of claim 1 wherein said air circulation means continuously supplies the stream of air bubbles to the freezing water within said bowl mold.

13. The self-contained, decorative ice bowl freezing apparatus of claim 1 wherein said air circulation support means comprises longitudinally extending support plates joined by laterally extending support plates to form an air circulation support frame.

14. The self-contained, decorative ice bowl freezing apparatus of claim 13 wherein said air circulation means is attached to and borne by said laterally extending support plates of said air circulation support frame.

15. The self-contained, decorative ice bowl freezing apparatus of claim 1 wherein said refrigerant liquid circulation means is continuous in operation.

16. The self-contained, decorative ice bowl freezing apparatus of claim 15 wherein said refrigerant liquid circulation means comprises a refrigerant pump disposed within said freezing tank and submersed within said refrigerant tank.

17. The self-contained, decorative ice bowl freezing apparatus of claim 16 wherein said refrigerant pump includes influent and effluent openings thereon, and a loop of refrigerant circulation tubing is connected to said effluent opening by means of a T-fitting for continuous circulation of refrigerant therein.

18. The self-contained, decorative ice bowl freezing apparatus of claim 17 wherein said loop of refrigerant circulation tubing contains a plurality of upwardly directed apertures in the upper surface thereof for providing substantial uniformity of circulation of the refrigerant liquid to the freezing tank.

19. The self-contained, decorative ice bowl freezing apparatus of claim 1 wherein said bowl mold support frame comprises a frame having at each end a pair of upwardly extending rod elements oppositely disposed on lateral sides thereof, each of which supports a transversely extending rod element for engaging and supporting said bowl mold.

20. The self-contained, decorative ice bowl freezing apparatus of claim 1 wherein said bowl mold includes an outward protrusion at the bottom thereof for forming the base of the bowl.

21. The self-contained, decorative ice bowl freezing apparatus of claim 1 wherein the depth of said ice bowl mold is no greater than one and one-half ($1\frac{1}{2}$) times the width of said ice bowl mold.

22. The self-contained, decorative ice bowl freezing apparatus of claim 1 wherein said air circulation means releases the stream of air bubbles into the freezing water at a depth which will permit freezing at the bottom and the sides of said bowl mold means to form an unfrozen central portion which is substantially hemispherical in shape.

23. The self-contained, decorative ice bowl freezing apparatus of claim 1 wherein said freezer tank is not substantially larger in horizontal cross-sectional dimension than said bowl mold means.

* * * * *